US010051967B2

(12) United States Patent
Chan

(10) Patent No.: US 10,051,967 B2
(45) Date of Patent: Aug. 21, 2018

(54) ADJUSTABLE THICKNESS TRAVEL PILLOWS

(71) Applicant: King Chan, Lake Oswego, OR (US)

(72) Inventor: King Chan, Lake Oswego, OR (US)

( * ) Notice: Subject to any disclaimer, the term of this patent is extended or adjusted under 35 U.S.C. 154(b) by 260 days.

(21) Appl. No.: 15/090,825

(22) Filed: Apr. 5, 2016

(65) Prior Publication Data

US 2017/0280902 A1 Oct. 5, 2017

(51) Int. Cl.
*A47C 7/36* (2006.01)
*A47C 7/38* (2006.01)

(52) U.S. Cl.
CPC ..... *A47C 7/383* (2013.01)

(58) Field of Classification Search
CPC ..... A47C 7/36
USPC ..... 5/636, 640, 657
See application file for complete search history.

(56) References Cited

U.S. PATENT DOCUMENTS 5,642,543 A * 7/1997 Huntley ..... A47G 9/10 5/490
6,617,908 B1 * 9/2003 Thomsen ..... H03F 3/005 327/337

* cited by examiner

*Primary Examiner* — Fredrick C Conley
(74) *Attorney, Agent, or Firm* — Mohr Intellectual Property Law Solutions, PC

(57) ABSTRACT

Thickness-adjustable travel pillows including travel pillows comprised of a flexible exterior cover and one or more inserts that are used to adjust the thickness and feel of the travel pillow. In some examples, the travel pillow includes multiple segments of inserts to allow a varying thickness across different portions of the travel pillow. In still further examples, the inserts themselves may vary in thickness.

20 Claims, 6 Drawing Sheets

ADJUSTABLE THICKNESS TRAVEL PILLOWS

BACKGROUND

The present disclosure relates generally to travel pillows. In particular, travel pillows that include a variety of inserts for adjusting the thickness of the travel pillows in various locations are described.

Modern day travelers may find themselves desiring to get rest while on a long flight or train ride, especially in the case of overnight flights such as redeyes, or international flights. However, airline seating is often designed with cost economy first, and passenger comfort second. Seats with limited recline make getting sleep difficult, and the small pillows provided by airlines often prove unsatisfactory as they fail to provide necessary support or are prone to slip out of position, leaving a passenger unable to get decent sleep. Consequently, horseshoe shaped travel pillows have become a popular item for travelers, as they stay in position around a user's neck and allow a user to lean their head to one side in a relatively stable position.

Known travel pillows are not entirely satisfactory for the range of applications in which they are employed. For example, existing travel pillows are typically constructed using a roughly horseshoe-shaped outer cover which is filled with a fill material such as small Styrofoam balls, seeds or husks such as buckeyes, feathers or down, cotton or polyester batting, or other such compliant material. Some variants instead use an inflatable bladder approximately in the shape of a horseshoe, which may or may not be provided with an exterior cover. Such travel pillows are typically filled to a roughly consistent height and in some cases may be tapered on either side of the horseshoe. For many users, the travel pillow offers inadequate side support for a user wishing to lay their head to one side or another. Furthermore, some airlines have added head rests to airline seats in an attempt to improve comfort to some extent. These head rests are designed to function while the passenger is awake, and do not provide sufficient support to allow for good sleep. Moreover, they may interfere with proper usage of conventional travel pillows, decreasing comfort by creating pressure on the back of the neck by pressing into the travel pillow at its thickest point and by extension pushing the user's head forward uncomfortably.

Thus, there exists a need for travel pillows that improve upon and advance the design of known travel pillows. Examples of new and useful travel pillows relevant to the needs existing in the field are discussed below.

SUMMARY

The present disclosure is directed to a thickness-adjustable travel pillow comprised of a flexible exterior cover and one or more inserts that are used to adjust the thickness and feel of the travel pillow. In some examples, the travel pillow includes multiple segments of inserts to allow a varying thickness across different portions of the travel pillow. In still further examples, the inserts themselves may vary in thickness.

DETAILED DESCRIPTION

Figure 1A:
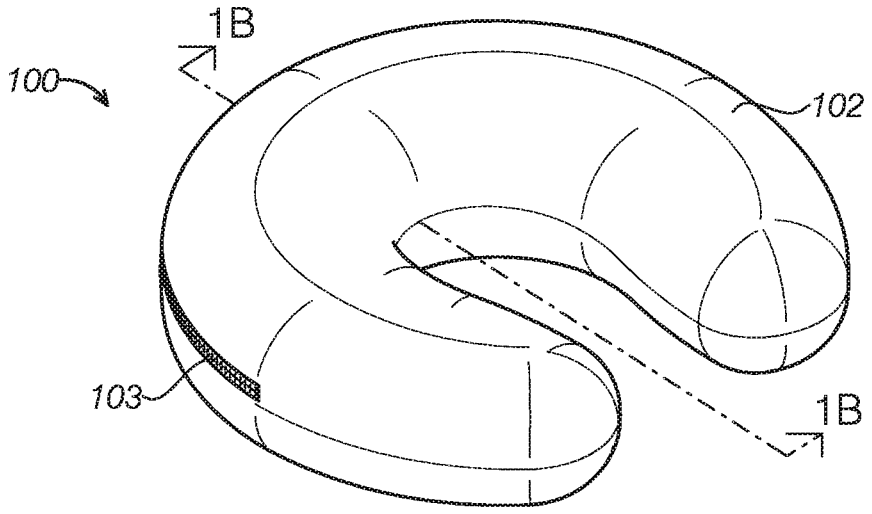
FIG. 1A is a perspective view of a first example of a thickness-adjustable travel pillow.

The disclosed adjustable thickness travel pillows will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various adjustable thickness travel pillows are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

With reference to FIGS. 1A-2D, a first example of a thickness-adjustable travel pillow, travel pillow 100, will now be described. Travel pillow 100 functions to provide a roughly horseshoe shaped pillow whose thickness can be adjusted at various points to accommodate varying user needs and seating conditions. The reader will appreciate from the figures and description below that travel pillow 100 addresses shortcomings of conventional travel pillows.

For example, by inserting one or more inserts that decrease the height of travel pillow 100 behind the user's neck relative to the sides, travel pillow 100 can be utilized with seats that have a preexisting head rest or neck cushion without creating an uncomfortable forward pressure on the user's neck. Likewise, where the seat lacks head or neck support, a larger set of inserts can be employed increase the height of travel pillow 100 behind the user's neck to add missing support to the user's head and neck. For users that prefer to side sleep, additional support can instead be directed to the "wings" of the horseshoe shape that surround the neck, rather than the back. In some airline seating positions, such as next to a wall with a window seat, the support can be tailored to fit easily between the user and the wall. Further, by virtue of using one or more interchangeable inserts, travel pillow 100 can be tailored in its firmness by using inserts made from different materials. For example, some users may prefer a firm yet contouring material such as viscoelastic foam, while others may prefer an inflatable bladder, a different type of foam material, or an insert consisting of a shell filled with traditional travel pillow material such as buckeye seeds.

Figure 1B:
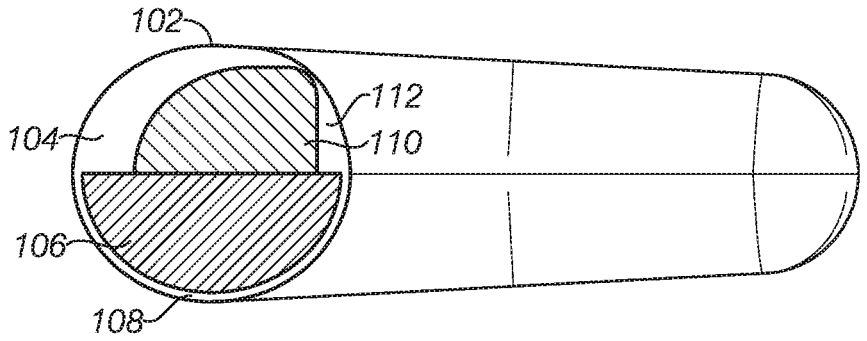
FIG. 1B is a cross sectional view of the travel pillow shown in FIG. 1A depicting the arrangement of the interior components.
Figure 1C:
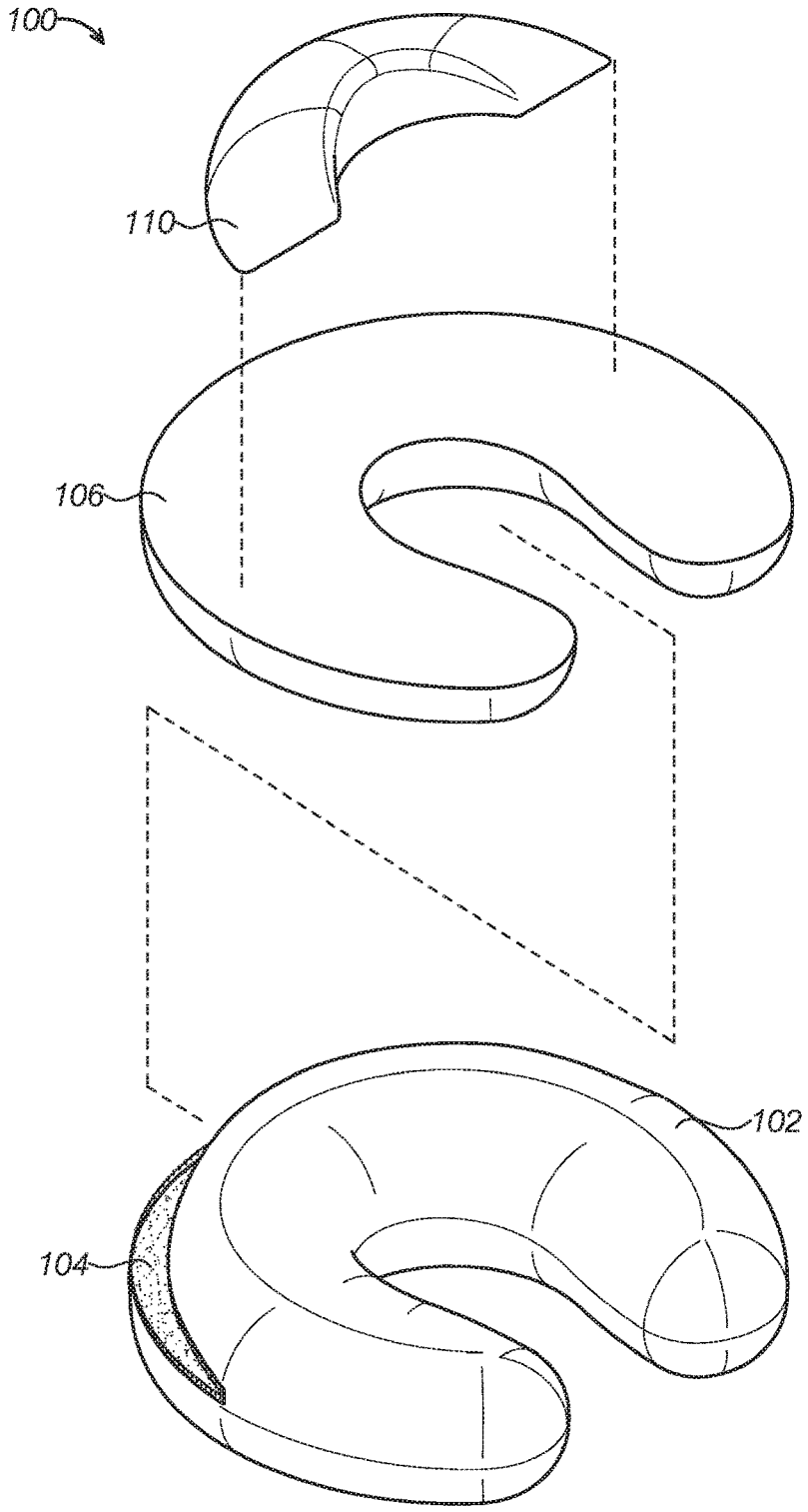
FIG. 1C is an exploded perspective view of the travel pillow shown in FIG. 1A depicting how the various components are assembled.

Referring now to FIGS. 1A-1C, thickness adjustable travel pillow 100 includes an exterior cover 102 that forms an interior cavity 104. In keeping with the typical travel pillow shape, exterior cover 102 is designed in a substantially horseshoe shape. A first insert 106 is disposed within the interior cavity 104 and shaped to fit within and fill a first portion 108 of interior cavity 104. A second insert 110 can be removably inserted into interior cavity 104, and is shaped to fit within and fill at least a second portion 112 of interior cavity 104. As shown in FIG. 2B, second insert 110 is substantially disposed upon first insert 106. Inserting second insert 110 achieves the invention's goal of modifying the overall thickness of travel pillow 100.

As can be seen in FIG. 1A, exterior cover 102 includes an opening 103 which allows access to interior cavity 104 for the insertion or removal of first insert 106 and second insert 110. Opening 103 is optionally equipped with a closing mechanism, such as a zipper, series of buttons, or snaps, or any other mechanism or device now known or later developed which allows opening 103 to be secured shut while travel pillow 100 is in use. Exterior cover 102 is preferably made from a non-irritating material that is comfortable for a user to rest his or her head or face upon, such as cloth, leather, vinyl, plastic, microfiber, fleece, a blend or combination of the foregoing, or other similar suitable material now known or later developed. Additionally, exterior cover 102 can be manufactured using a material that allows exterior cover 102 to expand or contract to closely fit the contours of the various inserts that may be placed within interior cavity 104. Such material can include elastic fabrics such as spandex or Lycra®, or other materials with similar characteristics. Exterior cover 102 could also incorporate some amount of cushioning material, such as a gel layer. Exterior cover 102 may preferably be manufactured from material that is breathable and/or capable of wicking away sweat and moisture to enhance user comfort.

In the example shown in FIG. 1C, first insert 106 and second insert 110 are shown clearly in their relationship with interior cavity 104 formed by exterior cover 102. First insert 106 is shown as having substantially the same overhead shape as exterior cover 102, but not filling the entirety of interior cavity 104, so as to leave second portion 112 of interior cavity 104. This second portion 112 accommodates second insert 110, which in the example shown in FIG. 1C, is shaped as only a portion of the overhead shape of exterior cover 102 and first insert 106. In this way, the height of travel pillow 100 when in use will vary depending upon the portion of the pillow the user lies upon. Moreover, second insert 110 can be implemented as a plurality of inserts, which either stack upon each other to increase height, or are disposed adjacent along the length of exterior cover 102 so as to vary the height of travel pillow 100 at various locations along its length. An example of this configuration will be discussed further herein.

First insert 106 and second insert 110 are preferably constructed of single blocks of viscoelastic foam, also known as "memory" foam. The inserts can also be constructed from any suitable material such as foam, rubber, cloth, inflatable bladders, gel-filled or liquid filled bladders, or other materials or devices of similar functionality that are now known or later devised that offer cushioning support to a user of travel pillow 100. As contemplated in this invention and depicted in the drawings, first insert 106 and second insert 110 are preferably large blocks of material that can vary in height, and that are easy to insert and remove from exterior cover 102 so as to allow for quick adjustment of pillow thickness. This contrasts from typical prior art travel pillows that are primarily a horseshoe shaped outer cover that is filled with a filling of small particles, such as Styrofoam balls, down, buckeye seeds, or cotton batting, with the outer cover sewn shut permanently to retain the filling, to avoid a mess should the filling leak. For the instant invention, inserts could be manufactured from the traditional fillings listed above, contained within a sealed cover and shaped similar to the disclosed foam inserts, so as to be inserted into exterior cover 102. Where inserts are so constructed, the sealed cover itself may be made of a flexible material, and can itself include padding such as gel.

Figure 2A:
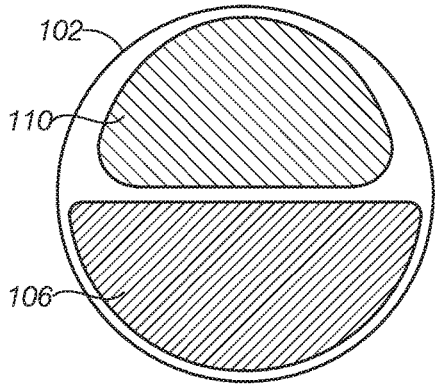
FIG. 2A is a cross sectional view of the travel pillow shown in FIG. 1A depicting an average thickness of the travel pillow presented by two inserts.
Figure 2B:
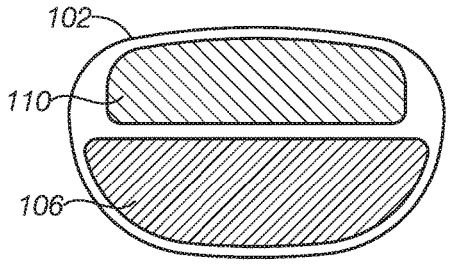
FIG. 2B is a second cross sectional view of the travel pillow shown in FIG. 1A depicting a reduced thickness of the travel pillow presented by two lower profile inserts.

Turning to FIGS. 2A-2B, the effect of differing heights of first insert 106 and second insert 110 are shown. Inserts can be manufactured in a variety of heights to allow the user of travel pillow 100 to customize the thickness of travel pillow 100 to meet their particular needs in any situation. FIG. 2A depicts a thickness presented by a typical height first insert 106 and second insert 110. FIG. 2B depicts a thickness presented by a reduced height first insert 106 and second insert 110. It should be readily understood that these are example thicknesses, and a nearly infinite varieties of thicknesses can be achieved, subject only to the expansion limits of exterior cover 102.

Figure 2C:
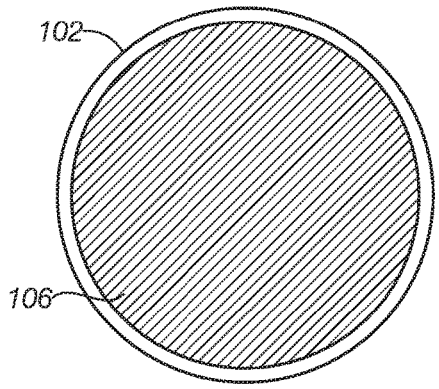
FIG. 2C is a third cross sectional view of the travel pillow shown in FIG. 1A depicting an average thickness of the travel pillow presented by a single insert.
Figure 2D:
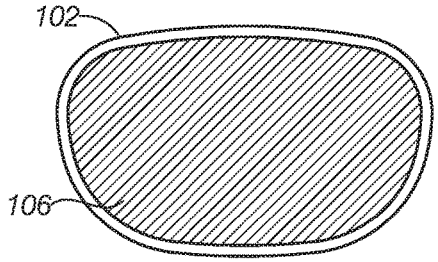
FIG. 2D is a fourth cross sectional view of the travel pillow shown in FIG. 1A depicting a reduced thickness of the travel pillow presented by a single lower profile insert.

FIGS. 2C and 2D reflect similar thicknesses as FIGS. 2A and 2B, respectively, but implemented using only a single first insert 106. Likewise, it should be readily understood that greater than two inserts may be utilized. Furthermore, where two or more inserts are used, the inserts themselves can each be manufactured from different materials so as to customize the overall feel of travel pillow 100. Where an insert is manufactured from an inflatable bladder, the bladder itself can have differing amounts of air added to further adjust the thickness of travel pillow 100 by modification of a single insert.

Still further, when only a single first insert 106 is utilized, if the single first insert 106 is manufactured from a type of foam or other material that is subject to being molded into shapes, single first insert 106 can itself be contoured with varying thicknesses in different portions of exterior cover 102 to achieve a similar effect to a first insert 106 and a second insert 110 disposed on top of first insert 106. For example, a single first insert 106 can be manufactured with a relatively thinner section behind the user's neck and thicker portions on either of the side wings to accommodate seating that has existing head and neck rest pillows.

Figure 3A:
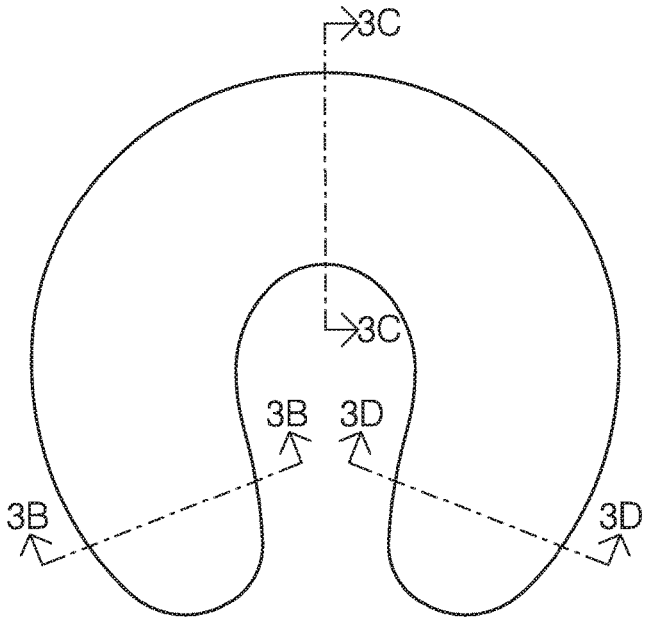
FIG. 3A is an overhead view of a second example of a travel pillow including multiple possible varying zones of thickness.
Figure 3B:
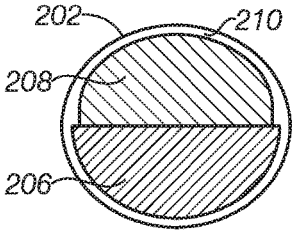
FIG. 3B is a cross sectional view of the travel pillow shown in FIG. 3A depicting the arrangement of the internal components at cutaway 3B-3B.
Figure 3C:
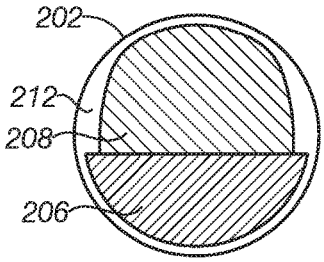
FIG. 3C is a cross sectional view of the travel pillow shown in FIG. 3A depicting the arrangement of the internal components at cutaway 3C-3C.
Figure 3D:
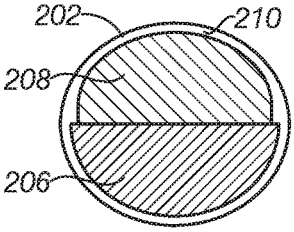
FIG. 3D is a cross sectional view of the travel pillow shown in FIG. 3A depicting the arrangement of the internal components at cutaway 3D-3D.
Figure 3E:
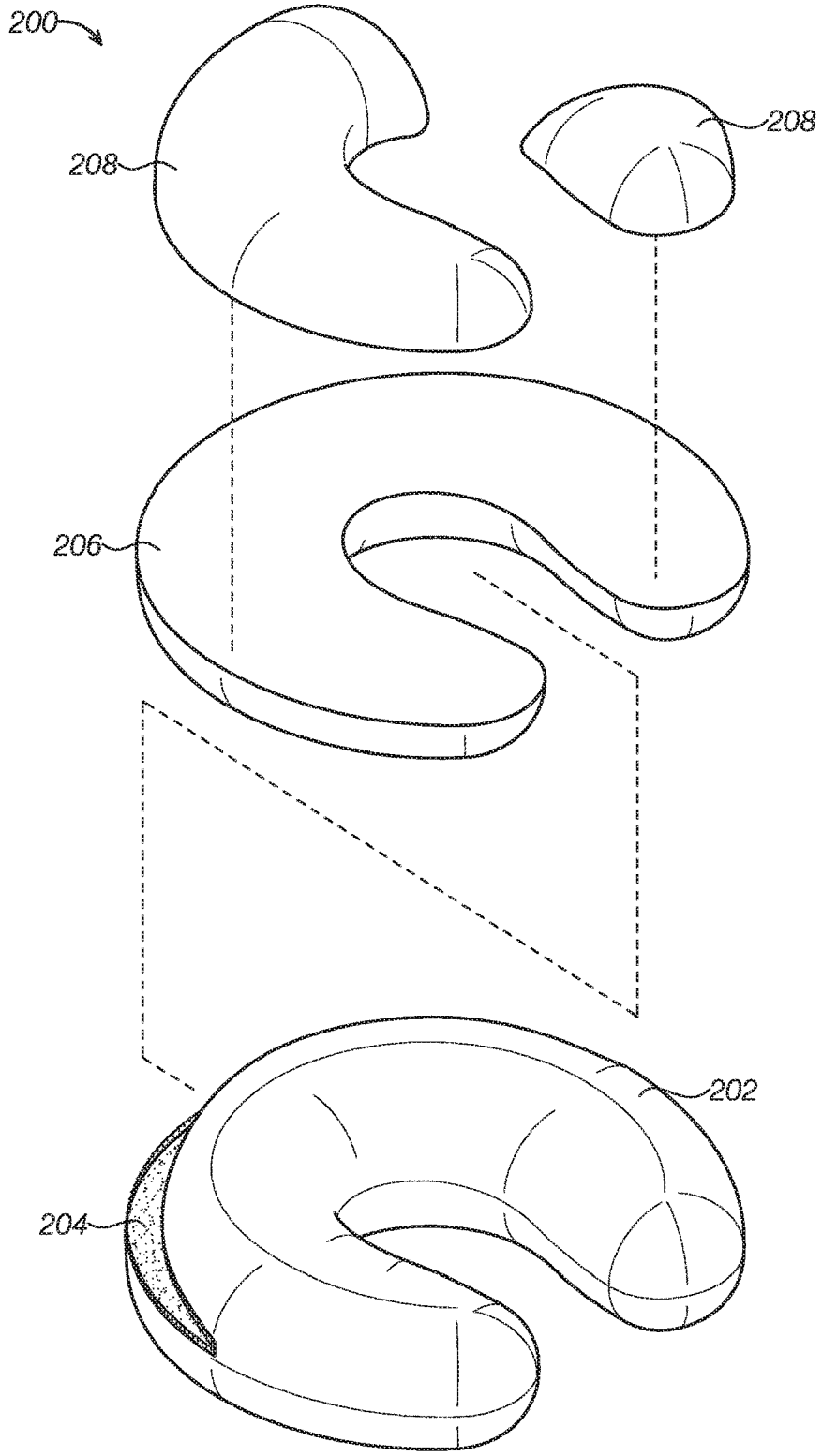
FIG. 3E is an exploded view of the travel pillow shown in FIG. 3A depicting how the various components are assembled.
Figure 4:
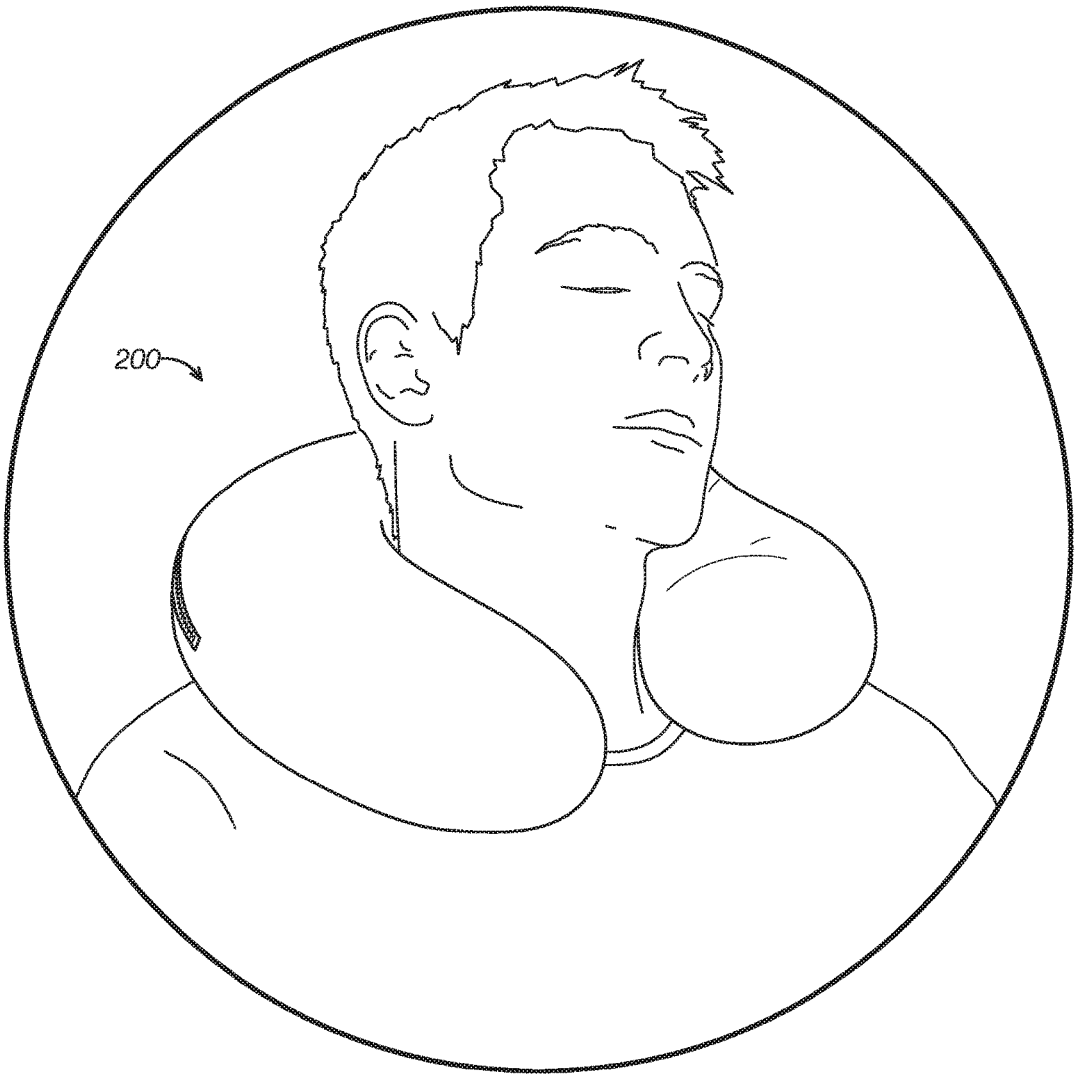
FIG. 4 is a perspective view of the travel pillow shown in FIG. 3A depicting it in a typical use scenario.

Turning attention to FIGS. 3A to 4, a second example of a thickness-adjustable travel pillow, travel pillow 200, will now be described. Travel pillow 200 includes many similar or identical features to travel pillow 100. Thus, for the sake of brevity, each feature of travel pillow 200 will not be redundantly explained. Rather, key distinctions between travel pillow 200 and travel pillow 100 will be described in detail and the reader should reference the discussion above for features substantially similar between the two travel pillows.

As can be seen in FIG. 3E, travel pillow 200 includes an exterior cover 202 that creates an interior cavity 204. Into interior cavity 204 are inserted a variety of inserts, including a first insert 206 and one or more second inserts 208.

FIGS. 3A to 3E depict a travel pillow with a plurality of second inserts that essentially divide up interior cavity 204 into a rear cavity portion 212 and two side cavity portions 210, corresponding each to the rear section and two side sections of the exterior cover 204. Into these various sections can be inserted second inserts 208 of varying height. FIGS. 3B, 3C and 3D depict a travel pillow 200 with a rear cavity portion 212 containing a second insert 208 that has a greater height that second insert 208 inserted into the two side cavity portions 210. However, it should be appreciated that rear cavity portion 212 can have a second insert 208 that is lower in height from one or both of the second inserts 208 inserted into the two side cavity portions 210. Moreover, each of the rear cavity portion 212 and two side cavity portions 210 can have a different height second insert 208, or possible no second insert 208, to provide a travel pillow that has multiple zones of thickness to accommodate a variety of different travel conditions and seating.

Finally, as seen in FIG. 3E, second insert 208 can optionally span between a side cavity portion 210 and rear cavity portion 212, or could span the entire length of travel pillow 200, disposed on top of the length of first insert 206.

FIG. 4 shows a possible preferred usage of travel pillow 200, which applies equally to travel pillow 100. Here, the user can lean to one side of travel pillow 200, which can have a first insert 206 and/or multiple second inserts 208 arranged so as to provide a natural cradle for the user's head while trying to rest in a travel seat, while simultaneously being able to accommodate a travel seat that may have built-in head rests that would otherwise interfere with the usage of a traditional non-thickness adjustable travel pillow.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A travel pillow that is thickness adjustable, comprising:

an exterior cover that forms an interior cavity, the exterior cover in a substantially horseshoe shape, the interior cavity comprised of a rear section configured to fit behind a user's neck, and two side sections contiguously disposed to the rear section configured to each fit on one side of the user's neck;

a first insert disposed within the interior cavity, and shaped to fit within and fill a first portion of the interior cavity, and wherein the first insert is thinner at the rear section of the interior cavity and configured to prevent forward pressure on the user's neck; and a second insert removably inserted into the interior cavity, and shaped to fit within and fill at least a second portion of the interior cavity, the second insert being substantially disposed upon the first insert, wherein inserting the second insert modifies the overall thickness of the travel pillow.

2. The travel pillow of claim 1, wherein the exterior cover is comprised of a material that can expand to accommodate varying sizes of second inserts.

3. The travel pillow of claim 1, wherein the first insert is constructed from a viscoelastic foam.

4. The travel pillow of claim 1, wherein the second insert further comprises a plurality of inserts.

5. The travel pillow of claim 4, wherein each of the plurality of inserts is inserted into a different part of the interior cavity, and is disposed upon the first insert when inserted into the interior cavity.

6. The travel pillow of claim 5, wherein each of the plurality of inserts modifies the thickness of a different section of the travel pillow such that each section of the travel pillow has a different thickness to create multiple zones of thickness.

7. The travel pillow of claim 1, wherein the second insert is constructed from viscoelastic foam.

8. The travel pillow of claim 1, wherein the second insert is constructed from an inflatable bladder.

9. The travel pillow of claim 1, wherein the exterior cover includes an outer surface that does not irritate the skin of the user.

10. The travel pillow of claim 9, wherein the outer surface of the exterior cover is made from fleece.

11. The travel pillow of claim 9, wherein the outer surface of the exterior cover is made from microfiber.

12. A travel pillow that is thickness adjustable, comprising:

an exterior cover that is substantially horseshoe in shape and that forms an interior cavity, the interior cavity comprised of a rear section configured to fit behind a user's neck, and two side sections contiguously disposed to the rear section configured to each fit on one side of the user's neck; and one or more inserts that can be removably inserted into the interior cavity;

wherein inserting the one or more inserts modifies the overall thickness of the travel pillow; and wherein the one or more inserts is thinner at the rear section of the interior cavity and configured to prevent forward pressure on the user's neck.

13. The travel pillow of claim 12, wherein each of the one or more inserts is inserted into a different part of the interior cavity.

14. The travel pillow of claim 13, wherein each of the plurality of inserts modifies the thickness of a different section of the travel pillow.

15. The travel pillow of claim 14, wherein at least one of the plurality of inserts is made from viscoelastic foam.

16. The travel pillow of claim 15, wherein the exterior cover is comprised of a material that can stretch to form-fit over the one or more inserts when the one or more inserts are inserted into the interior cavity.

17. A travel pillow that is thickness adjustable so as to accommodate varying positions of a user, comprising:

an exterior cover sized to fit around the neck of the user, comprised of a rear section to fit behind the user's neck, and two side sections contiguously disposed to the rear section that each fit on one side of the user's neck;

an interior cavity formed by the exterior cover, the interior cavity comprised of a rear cavity portion and two side cavity portions corresponding each to the rear section and two side sections of the exterior cover;

a first insert that fits into each of the cavity portions of the interior cavity, wherein the first insert is thinner at the rear section of the interior cavity and configured to prevent forward pressure on the user's neck; and one or more second inserts that each removably fit into one or more of the cavity portions.

18. The travel pillow of claim 17, wherein the one or more second inserts alter the thickness of each cavity portion into which each of the one or more second inserts is removably inserted.

19. The travel pillow of claim 18, wherein each of the one or more second inserts is comprised of viscoelastic foam.

20. The travel pillow of claim 18, wherein at least one of the one or more second inserts is comprised of an inflatable bladder.

* * * * *